US005947467A

United States Patent [19]

Billings et al.

[11] Patent Number: 5,947,467

[45] Date of Patent: Sep. 7, 1999

[54] SELECTIVELY ADJUSTABLE DECURLER

[76] Inventors: Bradford Billings, 24122 Jagger St., Lake Forest, Calif. 92630; Ryan S. Stevenson, 14861 Geneva, Irvine, Calif. 92604

[21] Appl. No.: 08/934,776

[22] Filed: Sep. 22, 1997

[51] Int. Cl.[6] ..... B65H 29/70

[52] U.S. Cl. ..... 271/188; 162/271; 493/459; 399/406

[58] Field of Search ..... 271/188; 493/459; 162/271, 270; 399/406

[56] References Cited

U.S. PATENT DOCUMENTS

| | | | |
|---|---|---|---|
| 5,017,970 | 5/1991 | Sakata | 162/271 |
| 5,066,984 | 11/1991 | Coombs | 162/271 |
| 5,183,454 | 2/1993 | Kurosawa et al. | 162/271 |
| 5,202,737 | 4/1993 | Hollar | 162/271 |
| 5,316,539 | 5/1994 | Leemhuis et al. | 162/271 |
| 5,392,106 | 2/1995 | Bigenwald et al. | 162/271 |
| 5,414,503 | 5/1995 | Siegel et al. | 162/271 |
| 5,519,481 | 5/1996 | Kuo | 162/271 |
| 5,565,971 | 10/1996 | Kuo et al. | 162/271 |
| 5,787,331 | 7/1998 | Ohkuma et al. | 162/271 |
| 5,848,347 | 12/1998 | Kuo et al. | 162/271 |

FOREIGN PATENT DOCUMENTS

| | | | |
|---|---|---|---|
| 31464 | 2/1985 | Japan | 271/188 |
| 267256 | 10/1989 | Japan | 271/188 |
| 32366 | 2/1993 | Japan | 271/188 |
| 162915 | 6/1993 | Japan | 271/188 |
| 183628 | 7/1994 | Japan | 271/188 |

*Primary Examiner*—William E. Terrell
*Assistant Examiner*—Patrick Mackey
*Attorney, Agent, or Firm*—Newton H. Lee, Jr.

[57] ABSTRACT

A decurler has an arched plate and a rotatable paper sheet feed roll defining an adjustable gap through which paper sheets driven by the roll exiting a copier or printer apparatus which causes the paper sheet to be curled transversely of the feeding direction, and the gap is selectively adjusted to control the decurling effect dependent upon the extent of the curl in the paper induced by the copying or printing process.

5 Claims, 2 Drawing Sheets

SELECTIVELY ADJUSTABLE DECURLER

BACKGROUND OF THE INVENTION

Typical printers and copiers used for producing printed copies of material on sheets of paper are known to cause various amounts of curling in the process created by the application of ink and heat in the reproduction process. The extent of the curl transverse to the direction of movement of the sheets of paper through and from the printing and copying machine varies considerably. Different paper thicknesses react and are curled somewhat differently. Different paper weights and content of the paper, as well as remanufactured paper, all exhibit different degrees of the tendency to curl, depending upon the applied heat, the surface area covered by the printed material, the moisture content in the paper and other factors.

In order to avoid, as much as possible, the tendency of the paper to curl during the printing or copying process so as to enable post-processing of the finished sheets by receiving the sheets in order and in reasonably well defined stacks or sets, without interference from excessive curl in the paper, various devices have been developed for decurling the paper as it exits the reproduction machine, including devices which tend to press the paper, devices for corrugating the sheets by application of deforming pressure laterally of the direction of sheet feed so as to add beam strength to the sheets of paper, and various other devices have been developed for the purpose of reversely deforming the sheets so as to eliminate the curl as the paper exits the reproducing machine and enters receivers, stackers, sorters or other sheet post-processing devices.

Included in the prior art devices for laterally or transversely deforming the sheets as they exit the reproduction apparatus is, for example, Coombs U.S. Pat. No. 5,066,984, granted Nov. 19, 1991. This patent discloses a decurling device which is disposed in the path of paper sheets leaving a printing unit or processor, such as an office copier or printer, and has an arcuate concave guide and a roll spaced from the guide to form a sheet path which is curved or arched oppositely to the direction in which the sheet is curled in the processor. The space between the guide and the roller is greater than the thickness of the paper and the paper is bent in the direction opposite to its curl as it passes through the arched space, while the beam strength of the paper and the change in direction of the paper maintain adequate drive friction on the sheet to feed the sheet. A selector isolates the decurler when it is not needed.

A variation of the device shown in the Coombs '984 patent is shown in Leemhuis et al U.S. Pat. No. 5,316,539, granted May 31, 1994, wherein the arched decurling guide is pivoted and biased by a spring towards the decurling roller which defines with the guide the gap or space in proportion to the rigidity or beam strength of the paper to be decurled so as to provide automatic adjustment based on papers within a range of different rigidity or beam strength.

SUMMARY OF THE INVENTION

The present invention addresses the problem of curl in sheets of paper exiting a sheet printing or copying machine by determining the gap or space between an arched plate and the sheet feeding roll forming the decurling gap as disclosed in the above referenced patents, but dependent upon the amount of curl observed or detected in the sheet, independently of the paper weight or rigidity, so that the decurling device of the invention can be adjusted to eliminate the curl, to the extent necessary or possible, independently of the quality of the paper, its weight, moisture content or other factors affecting the amount of curl caused by the printing or copying process.

In accomplishing the foregoing, the decurling device is adapted to be installed so as to receive paper sheets from the paper output from the typical page printer or copier and either perform the decurling function on the sheets as they pass through the decurler or provide for bypassing the sheets through the decurler without further treatment to the sheet receiving device, such as a stacker or sorter.

The decurling process is primarily determined by detecting, by observation, the amount of curl induced in the paper sheet by the printing or copying apparatus, and based on such an observation, the location of an arched decurling plate relative to the decurling feed roll which cooperate to form the curling gap can be selectively adjusted, not simply based upon the weight or thickness of the paper, but so as to assure that the curl induced in the paper during its printing or copying process can be substantially reduced, if not fully eliminated.

More specifically, means are provided to effect adjustment of the relationship between the arched guide and the decurling feed roll in increments by effecting a manual adjustment, although it is within the scope of the invention that in a more sophisticated environment, the adjustment may be made automatically by automatically detecting the paper curl and effecting the adjustment, say, using optical sensing means and motorized adjustment of the gap.

DESCRIPTION OF THE PREFERRED EMBODIMENT

Figure 1:
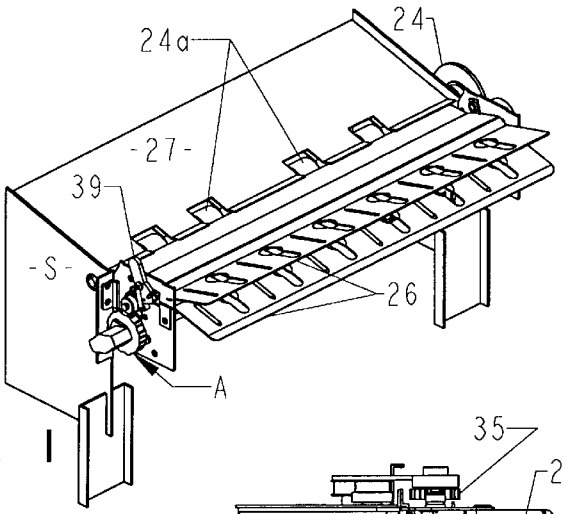
FIG. 1 is a perspective view illustrating a decurler made in accordance with the invention.
Figure 2:
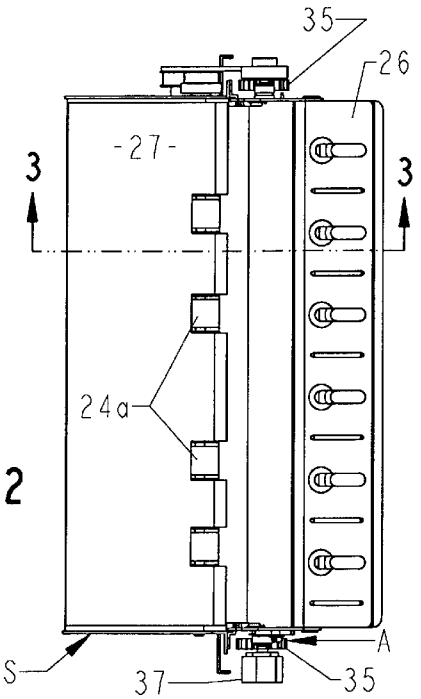
FIG. 2 is a top plan view thereof.
Figure 3:
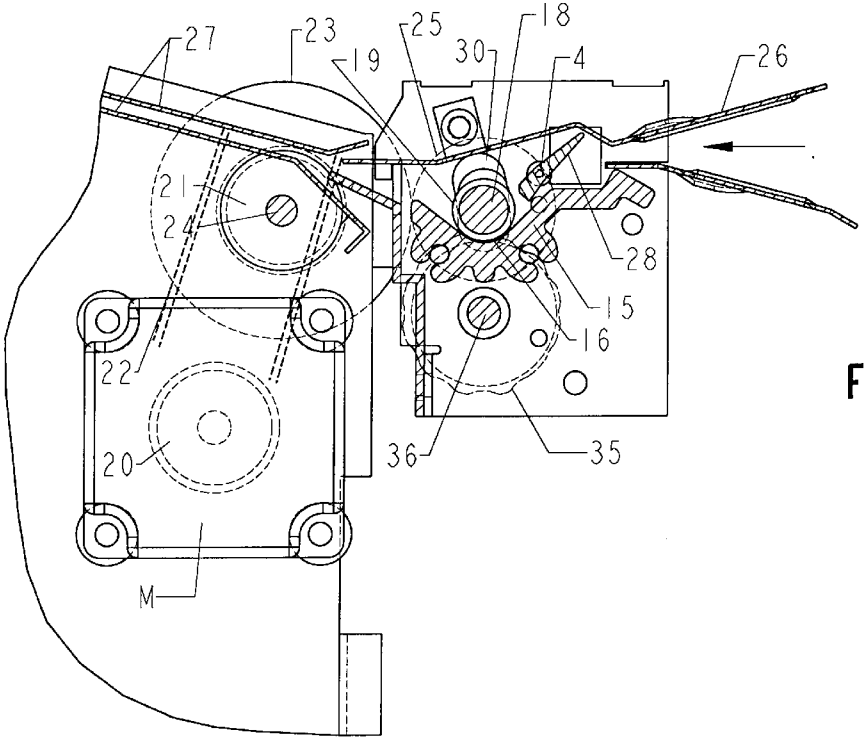
FIG. 3 is a vertical section taken on the line 3—3 of FIG. 2 and illustrating the decurling structure in an enlarged scale.

Referring to the drawings and as best seen in FIG. 3, the priyor art decurling devices are simple and involve certain basic elements, including an arched guide plate 15 having an arched surface 16, fixed in a frame structure 17, together with a transversely extended shaft 18 having sheet feed rollers of resilient material designated 19, whereby a sheet of paper passing through the arched clearance space between the surface 16 and the rollers 19 are transversely and oppositely bent to remove the typical curl in the paper caused by the printing or copying process.

As shown, the decurler is adpated to be mounted in a position on a stacker S or other receiver for the sheets. However, the decurler may be associated with other sheet transports such as inverters or in the sheet printer or copier structure.

In the illustrative embodiment, the shaft 18 is adapted to be driven by a motor M, drive pulleys 20 and 21, a belt 22, a large gear or wheel 23 on a shaft 24 for the stacker infeed rolls 24*a*, and a smaller gear or wheel 25, fixed on shaft 18 to rotate the same as a result of the drive to the stacker infeed rolls. However, it should be understood that the motor M and the drive to the decurler rolls 19 may be included in the decurler structure.

Further, the illustrative apparatus includes paper guides 26 through which sheets of paper pass into the decurler from the printing or copying apparatus and outlet guides 27 from which the sheets pass from the decurler to the stacker S, sorter or other receiver for the printed sheets.

Also typical of decurlers, a gate or deflector 28 is adapted to be moved between the position shown in FIG. 3 at which sheets entering through guides 26 are deflected downwardly to pass between the arched surface 16 and the resilient rollers 19 and an alternate position at which sheets may pass through the decurling structure.

It may be noted at this point that the beam strength of the paper passing through the gap between the arched surface 16 and the rollers 19 cause adequate friction between the paper and the resilient rollers to maintain a frictional drive force to move the paper through the decurler.

In accordance with the present invention, since the amount of curl in the paper sheets entering between the guides 26 differs, depending upon the weight, content, size or thickness and the amount of absorbed moisture in the paper, the present invention has, for its purposes, the provision of the subject novel decurler and method of utilizing it, whereby the arcuate gap between the arched surface 16 on plate 15 and the resilient rollers 19 can be varied depending on the amount of detected curl which is to be removed. In the simple form shown, detection of the amount of curl is visual.

Figure 4:
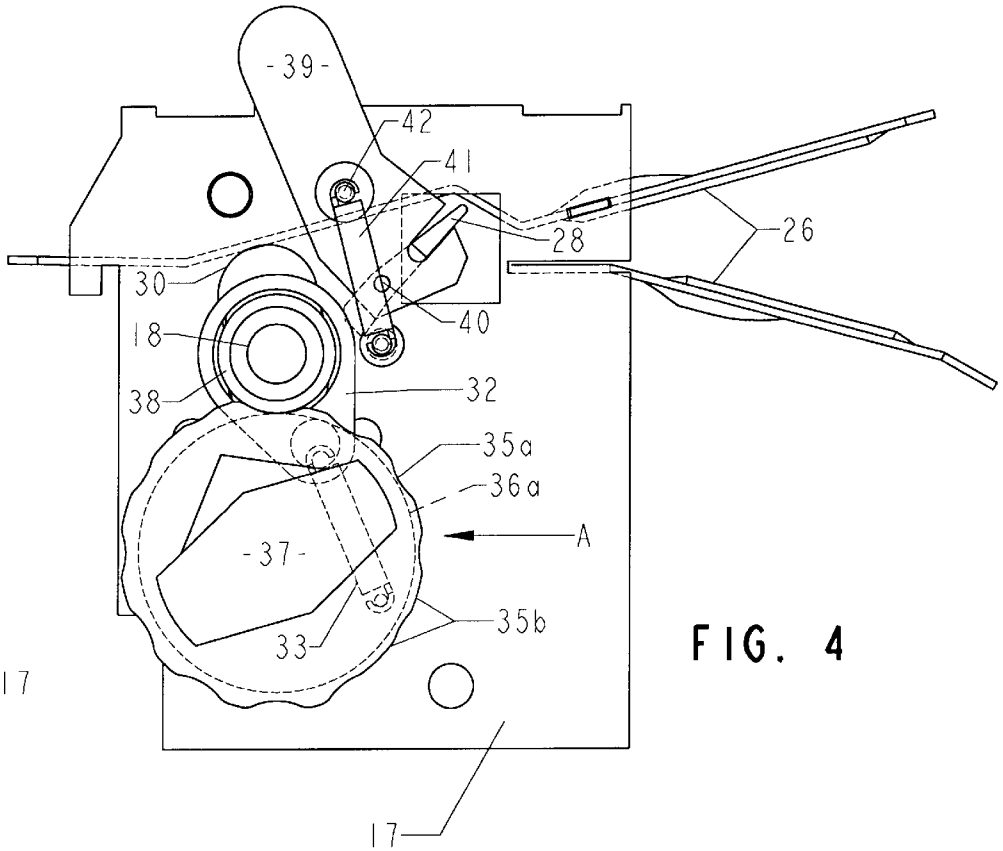
FIG. 4 is an end elevation of the decurling structure as viewed from the left hand end of FIG. 1.
Figure 5:
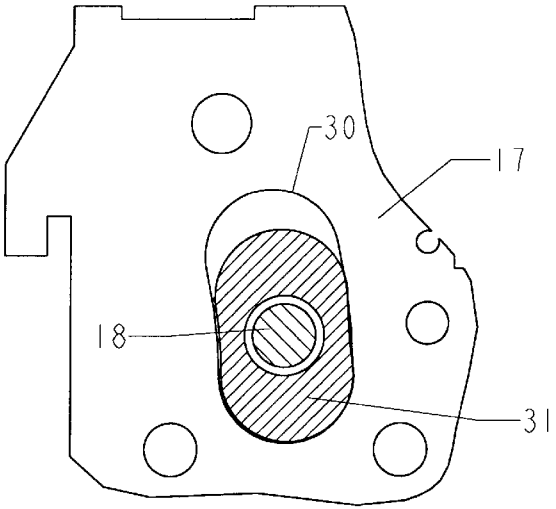
FIG. 5 is a detailed view illustrating the supporting structure allowing adjustment of the feed roll shaft.

Accordingly, as best seen in FIGS. 3, 4 and 5, the shaft 18 at its opposite ends is supported in the frame 17 for rotation and is shiftable so as to vary the space between the rollers and the arcuate surface 16, as best seen in FIG. 5, in vertically extended slots 30 in frame 17.

Since the shaft 18 is driven by the small gear 25 and the vertical movement of the shaft also causes vertical movement of that gear, the slot 30 is arched so that the small gear can retain its drive connection with the large gear 24 in the drive to the shaft 18. Also, for stability, shaft 18 is journaled at its opposite ends in a slidable member 31 in the respective slots 30 which conforms with the arcuate shape of the slots.

In order to adjust the position of the slidable members 31 and, therefore, the position of shaft 18 along slot 30, adjuster means A are provided as best seen in FIG. 4.

In the illustrated form, it will be seen that a yoke 32 is provided at each end of the shaft 18 outside of the frame walls 17 and the yoke is connected to a tension spring 33 to normally bias the shaft and, therefore, the sliding members 31 downwardly in the slots 30.

The adjustment means A is provided to limit or determine the position of the shaft 18, specifically by limiting the action of spring 33 moving the shaft 18 downwardly. An adjuster wheel or cam member 35 is provided at each end of a transversely extended shaft 36 at opposite sides of the housing 17. This cam wheel is rotatable at one end of the shaft 36 by an appropriate knob 37. As indicated by the broken line 36*a* which is concentric with the shaft 36, the outer periphery of each of the cam wheels 35 has a series of indentations spaced circumferentially of the outer periphery of the cam 35 and defining progressively greater rises 35*a* for the cam located between outwardly extended arched projections 35*b*, so that as the cam is rotated, a cam follower ring 38 engages between adjacent projections 35*b* to locate the follower 38 in a selected position engaged with a progressive rise 35*a* on the profile of the cam.

It will be clear that the rise in the cam profile determines the extent to which the shaft 18 and, therefore, the drive rollers 19 are moved away from plate 15 to define a varying space between the rollers and the arched decurler surface 16 of the plate 15 and that variations of means for selectively positioning the shaft 18 with respect to plate 15 may be employed for, say, automatically adjusting such position depending upon the amount of curl determined to exist in the paper being supplied to the decurler.

As previously indicated, typical decurler devices include a bypass gate or deflector 28. In the present construction a manually operated lever 39 is pivoted on one of the side walls 17 at 40 and a tension spring 41 is connected to the lever at 42 so that as the lever is pivoted in a right hand direction, the gate 28 will be caused to swing at a pivot 40 to a position which will cause the incoming sheet to bypass the decurler, in the case that the decurling is not necessary or desired.

In the use of the decurling apparatus thus far described, the method would involve, typically, detecting the amount of curl induced by the copying or printing apparatus. This can be accomplished visually when the deflector is positioned to cause the initial sheet or sheets being supplied to the decurler from the printer or copier and passing through the decurler. Thereupon, the position of the shaft 18 and the resilient rollers 19 with respect to the arched surface 16 can be adjusted for the purpose of eliminating the curl observed or detected. The observation or detection of the sheet curl can be repeated and the cam wheels adjusted to the optimum position for substantially eliminating the curl, and the operation can be repeated when different papers are being supplied through the decurler or when different machine operations cause a different degree of curl.

The invention, as contemplated hereby, will be best understood upon reference to the following claims.

We claim:

1. In a device for removing curl from sheets of paper exiting a printing machine comprising: means for decurling sheets including a rotary shaft having a paper drive roll thereon and an arched guide member extending partially about said drive roll in closely spaced relation to the outer periphery of said drive roll and forming an arcuate radial gap exceeding the thickness of the sheets to longitudinally deform the sheets between said drive roll and said guide member to cause the beam strength of the sheets between said drive roll and said guide member to provide drive friction with said feed roll, and means for rotating said shaft, the improvement wherein adjuster means are provided for selectively relatively adjusting said shaft and said guide member to vary the arcuate radial gap depending upon the degree of curl in the sheets of paper.

2. In a device for removing curl from sheets of paper exiting a printing machine comprising means for decurling sheets including a rotary shaft having a paper drive roll thereon and an arched guide member extending partially about said drive roll in closely spaced relation to the outer periphery of said drive roll and forming an arcuate radial gap exceeding the thickness of the sheets to longitudinally deform the sheets between said drive roll and said guide member to cause the beam strength of the sheets between said drive roll and said guide member to provide drive friction with said feed roll, and means for rotating said shaft, the improvement wherein adjuster means are provided for selectively relatively adiusting said shaft and said guide member to vary the arcuate radial gap depending upon the degree of curl in the sheets of paper, wherein said adjuster means includes means supporting said shaft for movement towards and away from said guide member and means for varying the position of said shaft.

3. In a device for removing curl from sheets of paper exiting a printing machine as defined in claim 2, including means for setting the position of said shaft in selected positions with respect to said guide member.

4. In a device for removing curl from sheets of paper exiting a printing machine as defined in claim 3, wherein said means for setting includes a rotary cam having circumferentially spaced different rises and a follower engaged with said rotary cam.

5. In a device for removing curl from sheets of paper exiting a printing machine as defined in claim 3, wherein said means for setting includes a rotary cam having circumferentially spaced different rises and a follower engaged with said rotary cam, said cam having portions for holding said follower in positions engaging a selected rise of said cam.

* * * * *